US007347235B2

(12) United States Patent
Beverly

(10) Patent No.: US 7,347,235 B2
(45) Date of Patent: Mar. 25, 2008

(54) LIGHT UP BAG BY CARRINGTON

(75) Inventor: Carrington Trice Beverly, 183 Acorn La., Danville, VA (US) 24541

(73) Assignee: Carrington Trice Beverly, Richmond, VA (US)

( * ) Notice: Subject to any disclaimer, the term of this patent is extended or adjusted under 35 U.S.C. 154(b) by 248 days.

(21) Appl. No.: 10/700,849

(22) Filed: Nov. 4, 2003

(65) Prior Publication Data

US 2005/0092409 A1 May 5, 2005

(51) Int. Cl.
*F21V 33/00* (2006.01)

(52) U.S. Cl. ..... 150/113; 362/154; 362/156

(58) Field of Classification Search ..... 362/154, 362/156; 150/113
See application file for complete search history.

(56) References Cited

U.S. PATENT DOCUMENTS

| | | | | | |
|---|---|---|---|---|---|
| 2,258,074 | A * | 10/1941 | Swanson | 362/203 |
| 2,320,409 | A * | 6/1943 | Cohen | 362/155 |
| 2,334,480 | A * | 11/1943 | Cross | 362/156 |
| 2,483,665 | A * | 10/1949 | Phillips | 362/203 |
| 2,904,091 | A * | 9/1959 | Reed | 150/117 |
| 3,045,900 | A * | 7/1962 | Zekendorf | 150/106 |
| 3,808,416 | A * | 4/1974 | Pottratz | 362/156 |
| 4,084,085 | A * | 4/1978 | Kim | 362/135 |
| 4,260,004 | A * | 4/1981 | Domke | 206/316.2 |
| 4,972,304 | A * | 11/1990 | Ylla | 362/156 |
| 5,073,844 | A * | 12/1991 | Coyner et al. | 362/156 |
| 5,424,926 | A * | 6/1995 | Myers | 362/156 |
| 5,960,476 | A * | 10/1999 | Danzy | 2/115 |
| D461,956 | S * | 8/2002 | Andrew | D3/303 |
| 6,932,487 | B2 * | 8/2005 | Aknine | 362/106 |
| 2001/0024365 | A1 * | 9/2001 | Aknine | 362/106 |
| 2004/0017683 | A1 * | 1/2004 | James | 362/154 |

* cited by examiner

*Primary Examiner*—Tri M. Mai

(57) ABSTRACT

The invention is the unique construction of a bag, such as a tote, purse, pocketbook, or duffel, encasing a battery powered light which is unseen unless illuminated. The lining, constructed in two sections, is separated by material sheer enough for the light to shine through. If needed, the light is held in place in the light section in a space cut from a piece of foam the same height of the light, cut to fit the width and depth of the bag. The light is accessed from the bag's exterior by an opening to facilitate changing the batteries or light which is then secured closed. In a separate compartment, the light does not mingle with items in the main chamber of the bag. A light within a fashionable bag, self contained, aids the location of items within the bag and provides beneficial lighting.

1 Claim, 5 Drawing Sheets

LIGHT UP BAG BY CARRINGTON

CROSS-REFERENCE TO RELATED APPLICATIONS

Not applicable

STATEMENT REGARDING FEDERALLY SPONSORED RESEARCH OR DEVELOPMENT not applicable

REFERENCE TO SEQUENCE LISTING, A TABLE, OR A COMPUTER PROGRAM LISTING COMPACT DISC APPENDIX not applicable

BACKGROUND OF THE INVENTION

The invention involves the construction of a bag, such as a tote, purse, pocketbook, or duffel, to encase a light. This answers the need to find specific articles in a bag, as well have the availability of beneficial lighting. In addition to lighting the interior search of the contents of a bag, the light can also be used to illuminate the lock of a car or the door of a home, etc. The light is designed to be encased in its own section of the bag as not to interfere with the contents of the bag or the contents to interfere with the light. This is unique as the light is incorporated in the construction of the bag rather than an illuminating device added to an existing bag. It also allows for access to the light in order to change the light or batteries or use the light elsewhere, as needed; however, this opening does not interfere with the total aesthetics of the bag.

BREIF SUMMARY OF THE INVENTION

The invention is the means by which a bag, such as a purse, tote, pocketbook, or duffel, is constructed. It allows for a separate compartment within the bag to encase a battery powered light. The compartment can be opened and secured closed to allow access to the light in order to change the light or batteries, or use the light elsewhere, as necessary. This feature, however does not interfere with the aesthetic appeal of the bag. The light apparatus is unseen within the design of the bag. Only the illumination from the light fixture is seen. A function of the light is to locate specific contents within the bag; however, the light is available to be used otherwise, as needed. The object is to provide beneficial lighting within the confines of a fashionable and stylish bag.

DETAILED DESCRIPTION OF THE INVENTION

The task of improving a bag, such as a tote, pocketbook, purse, or duffel, is accomplished by creating an area within the bag to place the light. The bag will be sewn as one bag yet have two separate compartments. One compartment will function as a traditional handbag to carry miscellaneous items and the second compartment will contain a light which will provide illumination of the contents of the bag. The light must also be accessible for maintenance while keeping the aesthetic appeal of the bag intact.

Establish the desired dimensions, height, width and depth, of the finished size of the bag to be made. Use these measurements to determine a pattern for the bag, as the construction will be the same whatever the size or shape of the bag. The cuts of the bottom or sides of the bag of the exterior and the lining materials as well as the divider for the lining would be adjusted to follow the chosen shape. The drawings following this description however, feature a bag with a rectangular bottom.

Select a light fixture to install in the light section of the bag. If the bag will be a different shape or larger than the light fixture, the light can be placed in foam to hold it in place. The height of the light fixture and the depth of the foam should be the same. An appropriate light would be a battery powered light such as a touch or push light that turns on and off when you touch the top. The light is accessible from the bottom of the bag.

Figure 1:
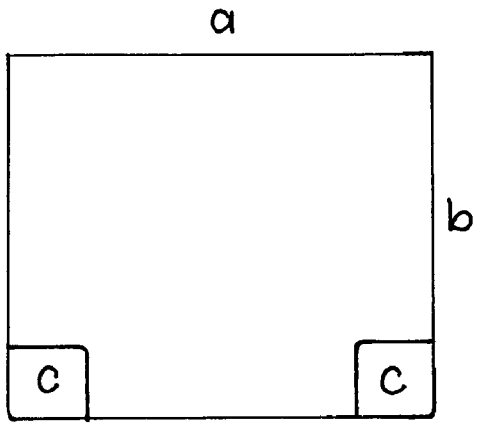
FIG. 1 is Side One of the exterior of the bag
Figure 2:
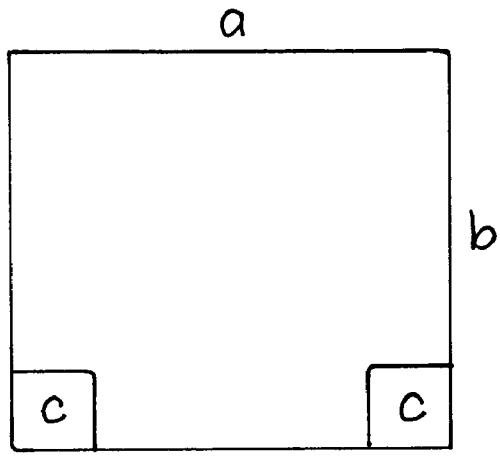
FIG. 2 is Side Two of the exterior of the bag

The exterior of the bag is cut in two pieces (FIG. 1, FIG. 2). To determine those measurements:

1. The width measurement is equal to the desired width plus the depth and add one inch to allow for a one-half inch seam on each side (FIG. 1-*a*, FIG. 2-*a*).
2. The height is determined separately for each side of the bag. Side One is the desired height plus half the depth measurement plus one inch to allow for one-half inch seams and subtract one-fourth inch from the bottom side (FIG. 1-*b*). Side Two of the bag is determined by measuring the same desired height plus half of the depth measurement plus one inch to allow for one-half inch seams plus one-fourth inch (FIG. 2-*b*). This differentiation allows for the installation of hook and loop fastener across the center bottom of the bag to gain access to the light compartment.
3. From the right and left side on the bottom, cut away a square measuring half of the depth measurement, subtracting one-fourth inch from the bottom of Side One (FIG. 1-*c*) and adding one-fourth inch to the bottom of Side Two (FIG. 2-*c*).

Figure 3:
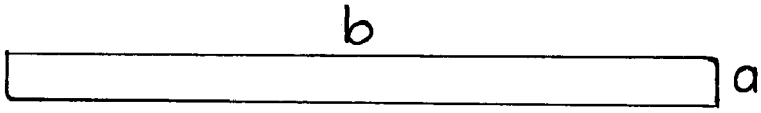
FIG. 3 is a handle made for the bag
Figure 4:
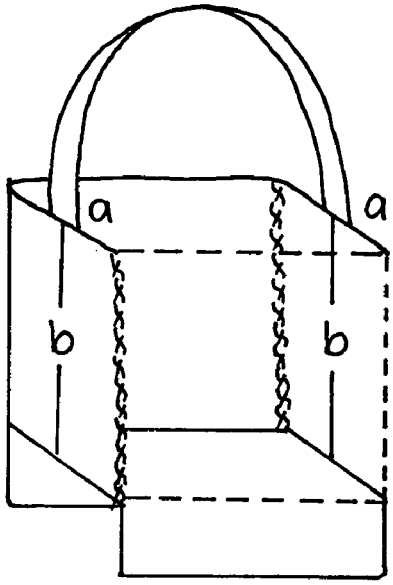
FIG. 4 shows FIG. 1, FIG. 2 and FIG. 3 assembled together to make the exterior of the bag

4. With right sides of the material together, stitch the side seams, which should be the same length, together (FIG. 4-*b*).
5. Fashion one or two handles of the desired length and width. Cut the material the desired length plus one inch to allow for a one-half inch seam on each side (FIG. 3-*b*). The width measurement should be three times the desired finished width measurement (FIG. 3-*a*). The material may be folded in half, right sides together and stitched a third of the distance from the open edge. The material should then be turned right side out. Another method would be to fold the material as desired with raw edges within the handle with the right side of the material facing out and topstitch. Stitch the handles in place on the exterior of the bag with raw edges and right sides together (FIG. 4*a*). The drawings following this description feature one handle centered over the side seams.

Figure 5:
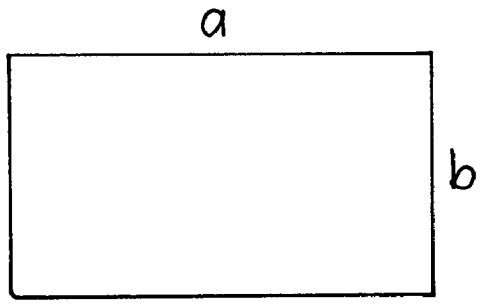
FIG. 5 is the top section of Side One of the lining
Figure 6:
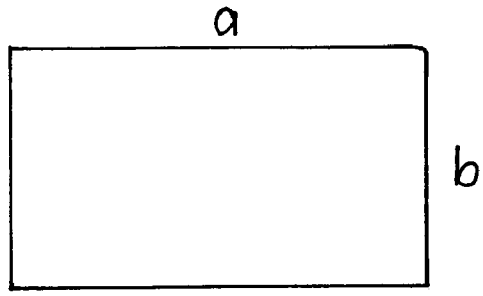
FIG. 6 is the top section of Side Two of the lining
Figure 7:
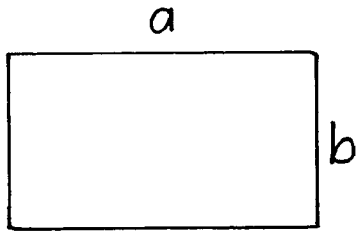
FIG. 7 is the piece which divides the top and bottom sections of the lining of the bag which is made of material sheer enough to allow light to pass through FIG. 8 is the bottom section of the lining for Side One
Figure 8:
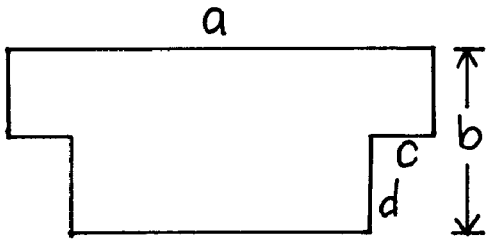
Figure 9:
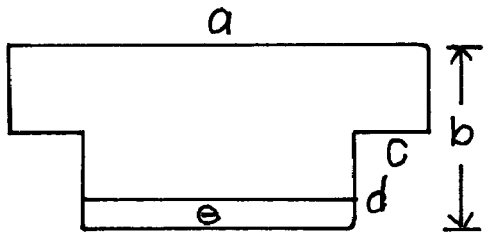
FIG. 9 is the bottom section of the lining for Side Two
Figure 10:
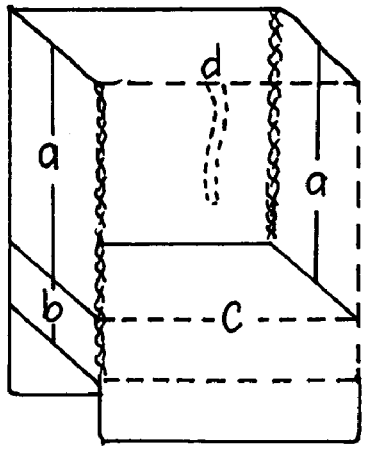
FIG. 10 shows FIG. 5, FIG. 6, FIG. 7, FIG. 8 and FIG. 9, the three sections of the lining, assembled together

The lining of the bag is made of five pieces of material (FIGS. 5, 6, 7, 8, 9) sewn together. To construct the lining of the bag (FIG. 10):

1. Make the top section of the lining by cutting the two pieces of the lining material to the finished width of the bag plus the depth measurement plus one inch to allow for a one-half inch side seam on each side (FIG. 5-*a*, FIG. 6-*a*)). The height of the bag should be cut to the finished height of the bag minus the depth of the foam plus one inch for a one-half inch top seam and a one-half inch bottom seam (FIG. 5-*b*, FIG. 6-*b*). Stitch the side seams together (FIG. 10-*a*).
2. The piece that divides the light compartment from the main compartment of the bag should be made of a material that is sheer enough to allow light to pass through (FIG. 7). To make this, cut a piece one inch longer than the measurement of the depth (FIG. 7-*b*) and one inch longer than the measurement of the width (FIG. 7-*a*) of the finished size and shape of the bag. This allows for a half-inch seam on all sides.
3. Construct the bottom section which encases the light by cutting two pieces the width of the finished bag plus the depth plus one inch to allow for a one-half inch seam on each side (FIG. 8-*a*, FIG. 9-*a*). The height should measure the depth of the foam plus one inch to allow for one-half inch seams plus half of the depth measurement plus three-fourths inch (FIG. 8-*b*, FIG. 9-*b*). From the bottom corner of each side, cut a rectangle which is half the depth measurement into the width (FIG. 8-*c*, FIG. 9-*c*) and half the depth measurement plus three-fourths inch into the height down to the bottom (FIG. 8*d*, FIG. 9*d*). Trim one-half inch from the bottom edge of Side Two (FIG. 9-*e*). This cut should be the same as the bottom of the exterior of the bag; however, Side One of the exterior should match Side Two of the lining and Side Two of the exterior should match Side One of the lining. Stitch the side seams together (FIG. 10-*b*).
4. Assemble the top section, divider and bottom section by pinning the three pieces together with the right side of the bottom side of the top section facing the right side of the edge of the divider and the right side of the top edge of the bottom section facing the wrong side of the edge of the divider. Position the material so the side seams of the top and bottom sections are lined up with the center of the short sides of the divider. Clip one-half inch into the bottom edge of the top section and the top edge of the bottom section at a distance of half the depth measurement from each side of each side seam. This will allow the material to make a corner and lay flat or follow the desired shape of the bag. Stitch the three pieces together (FIG. 10-*c*).

If a closure is desired, either make a tie or use a zipper, button and loop, snap, or hook and loop fastener. The drawings following this description feature a tie. To make a tie as a closure of either exterior or lining material, cut two pieces of material the desired length plus one-half inch. The width measurement should be double the desired measurement plus one inch for seams. Fold material in half lengthwise with right sides together and stitch one-half inch from open edge, leaving one end open and stitch across the other end either straight or at a diagonal as desired. Trim seams and corners. Turn fabric through the open end so the right sides are out. Press. Baste the open edge of one tie to the top edge of the center of Side One and one tie to the top edge of the center of Side Two of the bag so the raw edges are together. Be sure the right sides of the material are facing together (FIG. 10-*d*).

Figure 11:
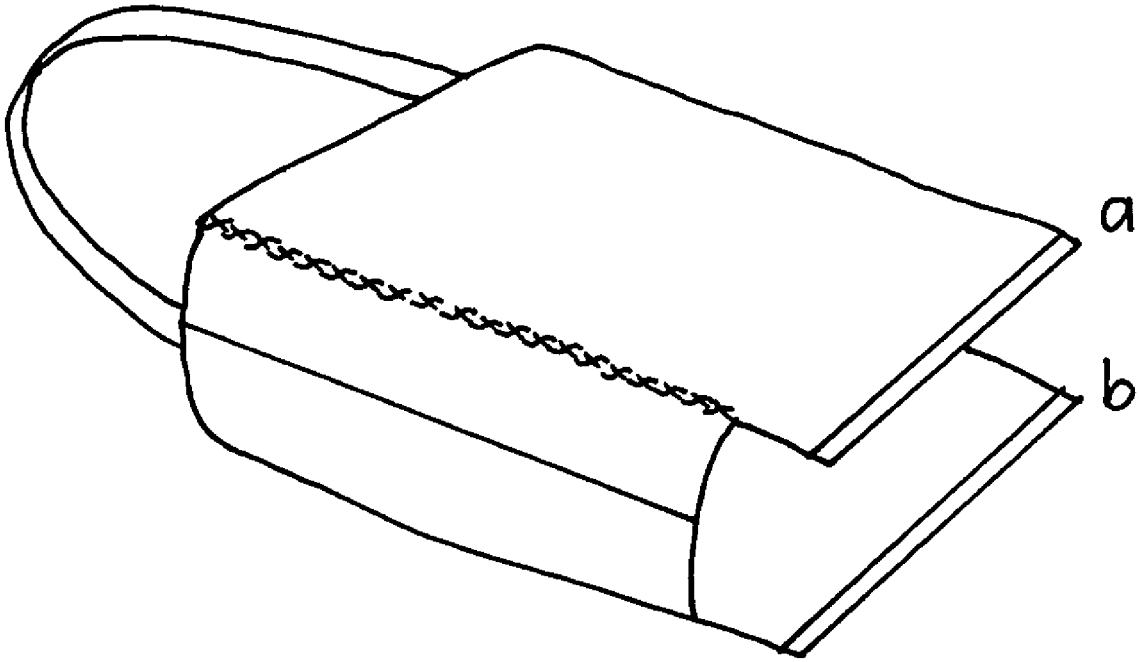
FIG. 11 shows the installation of the hook and loop fastener on the bottom of the bag

Assemble the exterior of the bag and the lining. Place the right side of the exterior of the bag facing the right side of the lining. Side One, the shorter side, of the exterior of the bag should be facing Side One, the longer side, of the lining of the bag. Side Two, the longer side, of the exterior of the bag should be facing Side Two, the shorter side, of the lining of the bag. Be sure the handles and ties are correctly placed between the exterior and lining of the bag and the right sides are facing the right side of the exterior of the bag. Stitch around the top of the bag. Turn the bag so the right sides are out on both exterior and lining of the bag. Topstitch top of bag if desired (FIG. 11).

Figure 12:
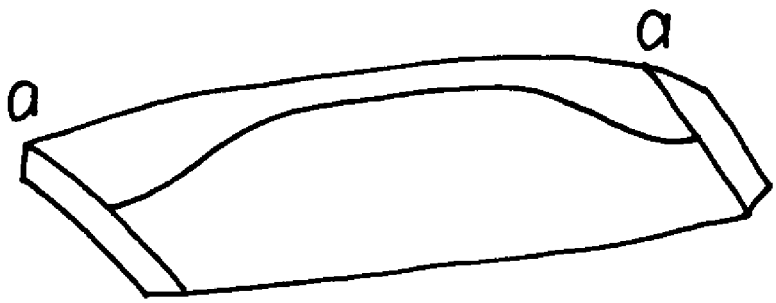
FIG. 12 shows the bottom side seams of the bag front to back which create the depth of the bag
Figure 13:
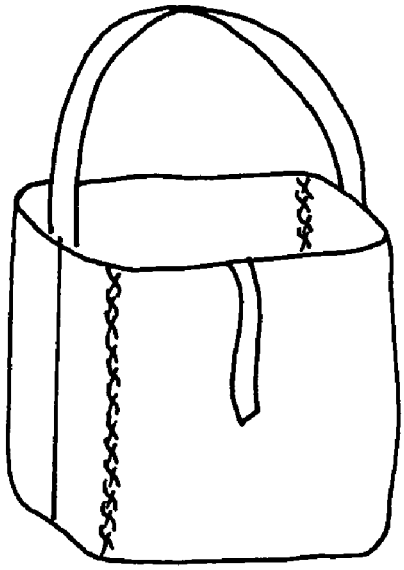
FIG. 13 is a front view of the exterior of the completed bag

To finish the bottom of the bag:

1. On Side One, fold the longer side of the lining over the shorter side of the exterior of the bag. Stitch one side of five-eighths or three-fourths inch width hook and loop fastener to the length of the width of the bag. Stitch on both sides of the hook and loop fastener (FIG. 11-*a*). On Side Two, fold the longer side of the exterior of the bag over the shorter side of the lining of the bag and stitch the other side of the hook and loop fastener over the length of the width of the bag. Stitch on both sides of the fastener (FIG. 11-*b*).
2. Fold and tuck the top section of the bag into itself to enable turning the bottom section inside out over the top section. Close the bottom of the bag with the hook and loop fastener. Stitch both sides of the bottom together with a one-half inch seam (FIG. 12-*a*).
3. Open hook and loop fastener and turn bag right side out (FIG. 13).

The bag now has two sections. The top section is intended to carry personal belongings and the bottom section will house the light.

Figure 14:
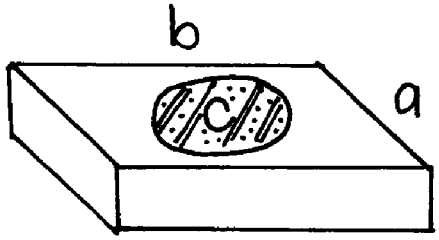
FIG. 14 shows the foam as cut to specifications
Figure 15:
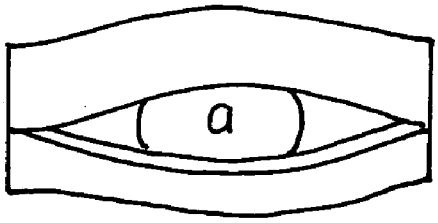
FIG. 15 shows the bottom of the bag with the hook and loop fastener open to expose the light fixture
Figure 16:
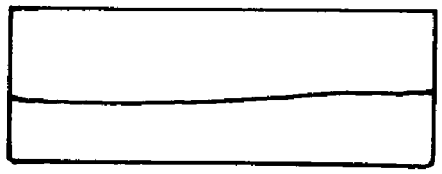
FIG. 16 is the bottom view of the bag with the hook and loop fastener

Install the light in the bottom section of the bag. Cut a piece of foam the same thickness as the height of the light to fit the finished depth (FIG. 14-*a*) and width (FIG. 14-*b*) of the bag. Cut an opening from top to bottom in the middle of the foam the size of the light (FIG. 14-*c*). Place the foam in the bottom section of the bag (FIG. 15). Place the light in the opening of the foam inside the bottom of the bag (FIG. 15-*a*). Close the bottom of the bag with the hook and loop fastener (FIG. 16).

Figure 17:
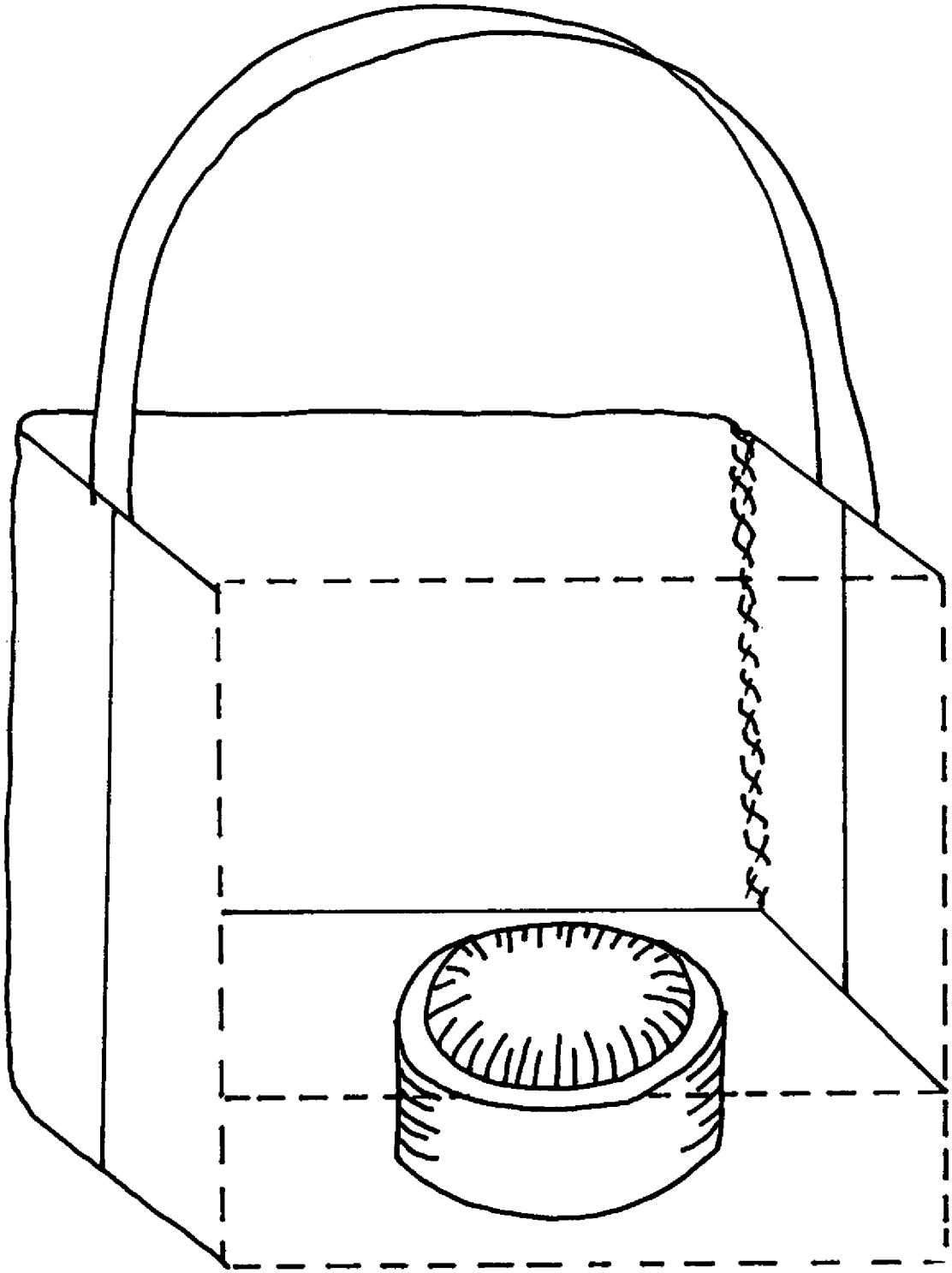
FIG. 17 is a cross sectional view of FIG. 13, the completed bag, with the light fixture installed

The top portion is used to carry items. The light in the bottom compartment shines through the material of the divider allowing light to locate contents within the bag (FIG. 17). Thus, this is a handbag uniquely designed and constructed to provide illumination. An added advantage is that light is always available and could also be used to illuminate space outside the bag if necessary.

What is claimed:

1. A hand bag having:

two side walls having a first length, two end walls having a second length, a bottom wall, said sidewalls and end walls define an opening of said hand bag, a partition wall having a first edge and a second edge defining an area substantially identical to said opening of said hand bag, said partition wall defining one compartment on the upper portion, and a second compartment on a lower portion of the bag, said second compartment having a depth, a first compartment side, and a second compartment side, a light having cylindrical housing portion and a dome protruding from said cylindrical portion, said light is being activated by touching the top dome to provide illumination through said partition wall, a foam insert positioned inside the second compartment, said insert having two side walls and two end walls, said two sidewalls and two end walls of said insert defining a volume to provide a substantial fit into the second compartment, said foam insert having a cylindrical cut out to provide a substantial fit for said housing of said light, said dome being protruding in the direction of said first compartment side, said bottom wall of the said bag having two flaps, said flaps having hooks and loops fasteners on each flap to provide access to the second compartment of the hand bag.

* * * * *